US008798449B2

(12) United States Patent
Glover

(10) Patent No.: US 8,798,449 B2
(45) Date of Patent: Aug. 5, 2014

(54) CONDUIT FOR A CONDENSATION REMOVAL PUMP

(75) Inventor: Brian Howard Glover, Yateley (GB)

(73) Assignee: Charles Austen Pumps Limited, Surrey (GB)

( * ) Notice: Subject to any disclaimer, the term of this patent is extended or adjusted under 35 U.S.C. 154(b) by 730 days.

(21) Appl. No.: 12/863,579

(22) PCT Filed: Jan. 20, 2009

(86) PCT No.: PCT/GB2009/000147

§ 371 (c)(1),
(2), (4) Date: Sep. 30, 2010

(87) PCT Pub. No.: WO2009/093010

PCT Pub. Date: Jul. 30, 2009

(65) Prior Publication Data

US 2011/0019984 A1 Jan. 27, 2011

(30) Foreign Application Priority Data

Jan. 21, 2008 (GB) ..... 0801063.9

(51) Int. Cl.
*F24H 1/08* (2006.01)
*F24H 1/10* (2006.01)
*F25D 21/00* (2006.01)

(52) U.S. Cl.
USPC ..... 392/471; 392/478; 62/150; 62/272

(58) Field of Classification Search
USPC ..... 392/465, 471–478, 497–503, 485; 62/150, 272, 285, 288
See application file for complete search history.

(56) References Cited

U.S. PATENT DOCUMENTS 996,588 A 6/1911 Kennedy
3,227,872 A * 1/1966 Nemeth ..... 250/289

(Continued)

FOREIGN PATENT DOCUMENTS

CH 695513 A5 6/2006
DE 29909689 U1 8/1999

(Continued)

OTHER PUBLICATIONS

British Search Report for British Patent Application No. GB0801063.9, Dated Apr. 9, 2008.

(Continued)

*Primary Examiner* — Tu B Hoang
*Assistant Examiner* — Michael Laflame, Jr.
(74) *Attorney, Agent, or Firm* — Patterson & Sheridan, LLP

(57) ABSTRACT

A conduit (51) for a condensate removal pump is disclosed comprising a tubular member (47) having a profiled rim (53, 54) at a distal end, profiled such that only a portion of the rim lies in a plane located at the extreme distal end of the tubular member perpendicular to the axis of the tubular. A resilient membrane (52) which has a slit extends across the interior of the tubular member and is arranged to open, to allow water to pass, when water is drawn through the conduit. A combined sensor and suction tube assembly (50) is also disclosed comprising a tube (55), a self heating thermistor (56) coupled to the tube, and a relay means (69) to relay an operational parameter of the self heating thermistor, indicative of the presence of water, to a condensate removal pump. The combined sensor and suction tube assembly is sized to fit within a pipe having an inner diameter of 20 mm.

14 Claims, 3 Drawing Sheets

(56) References Cited

U.S. PATENT DOCUMENTS

| | | | | | |
|---|---|---|---|---|---|
| 3,905,203 | A * | 9/1975 | Jacob | 62/272 |
| 4,383,415 | A * | 5/1983 | Jacob | 62/81 |
| 4,392,782 | A * | 7/1983 | Kuehn et al. | 417/36 |
| 4,507,056 | A * | 3/1985 | Allen | 417/54 |
| 5,301,516 | A * | 4/1994 | Poindexter | 62/126 |
| 5,323,620 | A * | 6/1994 | Wood | 62/188 |
| 5,479,707 | A * | 1/1996 | Alvarez et al. | 29/890.039 |
| 5,882,416 | A * | 3/1999 | Van Buskirk et al. | 118/726 |
| 6,796,135 | B1 * | 9/2004 | Bhatti et al. | 62/150 |
| 2005/0144803 | A1 * | 7/2005 | Zubik et al. | 34/80 |
| 2007/0000279 | A1 * | 1/2007 | Koo | 62/474 |
| 2009/0071181 | A1 * | 3/2009 | Spanger | 62/262 |

FOREIGN PATENT DOCUMENTS

| | | | |
|---|---|---|---|
| DE | 10241237 | A1 | 3/2004 |
| EP | 1318361 | A2 | 1/1985 |
| EP | 0552913 | A1 | 7/1993 |
| EP | 0849569 | A1 | 6/1998 |
| EP | 1486739 | A2 | 12/2004 |
| EP | 1600676 | A1 | 11/2005 |
| JP | 7280417 | A | 10/1995 |
| JP | 2001159556 | A | 6/2001 |
| JP | 2002162285 | A | 6/2002 |

OTHER PUBLICATIONS

British Search Report for British Patent Application No. GB0801063.9, Dated May 30, 2008.

International Search Report for International Application No. PCT/GB2009/000147, Dated Jul. 15, 2009.

* cited by examiner

CONDUIT FOR A CONDENSATION REMOVAL PUMP

The present invention relates to conduits for use with condensate removal pumps which are employed to remove waste water from air conditioning systems.

Air conditioning systems take in warm air and expel cooler air in order to provide a more comfortable living or working environment. The process of chilling the air causes condensation to form on the heat exchanger, producing a steady stream of water dripping down into a collection tray and then to a drain.

The amount of water produced depends on the humidity level in the environment and other factors, but 10 litres every hour is quite common.

Many air conditioning installations, for example ceiling or wall mounted air conditioning units, are sited away from a convenient drain. In these cases a self priming condensate removal pump is typically employed to convey the water through a discharge tube to the outside of a building. Such pumps are preferably demand driven so that they only operate when there is water waiting to be discharged from the system.

There are many different techniques for sensing when the pump is required to run, ranging from measuring differential temperature between the air entering and leaving the air conditioning unit, to water level detection using float switches or conductivity probes of various sorts.

Care has to be taken when installing condensate removal pumps and their associated sensors to ensure that they can be easily serviced and maintained. Some buildings can require over 100 pumps to be fitted and the time taken to install these pumps can have a significant impact on project costs.

In practice, differential temperature sensors are preferred to water level sensors since water level sensors can be difficult and time consuming to install, particularly when there is limited space is available. However, differential temperature sensors are less accurate than water level sensors and can leave the pump running for long periods of time, even when there is no water to pump. This is wasteful of energy, causes wear to the pump and creates unwanted noise.

A further problem associated with known condensate removal pumps is the noise created when the water has nearly run out. Typically a hose conveys the water from the drainage pipe of the air conditioning unit to the inlet of the pump. When the water level reaches the inlet end of the hose a mixture of water and air is drawn up the tube causing a gurgling sound, similar to that made by a drinking straw, to be produced. This noise causes irritation and complaints from users. This is a particular problem when differential temperature sensing is used to control the pump as the pump is left running for long periods of time.

In a first aspect, the present invention provides a conduit for a condensate removal pump comprising a tubular member having a rim at a distal end thereof, wherein the rim is profiled such that only a portion of the rim lies in a plane which is located at the extreme distal end of the tubular member and which is perpendicular to the axis of the tubular member, and a resilient membrane which extends across the interior of the tubular member; the membrane having at least one slit which is arranged to open to allow water to pass through the membrane when water is drawn through the conduit by a condensate removal pump.

The conduit of the present invention helps to minimise noise nuisance from gurgling as the membrane helps to minimise noise escaping from within the tubular member and the profiled rim helps to prevent a mixture of water and air being draw into the tubular member.

As the water is pumped away, the water level surrounding the tubular member decreases. The surface of the water forms a meniscus on the outer surface of the tubular member due to surface tension. As the water level moves past the rim the meniscus clings onto the rim until the water level has decreased to such an extent that the surface tension is no longer able to maintain the meniscus in contact with the rim. At this point the meniscus breaks suddenly.

While the meniscus remains intact, air is unable to pass into the tubular member. However, when the meniscus breaks, air passes into the tubular member through the gap created between the surface of the water and the rim. Because the rim of the present invention is profiled, the peripheral area through which the air flows is greater than it would be if the rim were planar and parallel to the surface of the water. The velocity and pressure of the air flowing past the rim is therefore lower and the air is consequently less likely to stir up the surface of the water as it passes. This leads to a reduction in the amount of water that becomes entrained in the flow of air and subsequently drawn into the tubular member.

The rim may have any desired configuration. For example, an oblique taper or curved configuration. However the rim preferably has a castellated configuration which helps to ensure that the meniscus breaks at the lowest possible water level.

In a preferred example the membrane comprises a single slit to minimise the number of noise paths through the membrane.

Preferably, the membrane is located proximate the distal end of the tubular member to maximise the noise shielding effect.

In one preferred example the membrane is supported by a support member and moveable with respect to the tubular member. In this example a resilient member is provided for controlling movement of the membrane. This arrangement provides a safeguard in the event that the slit becomes blocked by allowing the membrane to move and provide a bypass for the water.

In a second aspect, the present invention provides a combined sensor and suction tube assembly comprising a tube having a proximal end which is arranged to be connected to the inlet of a condensate removal pump and a distal end which is arranged so that water may be drawn through the tube, a self heating thermistor coupled to the tube, and a relay means which is arranged to relay an operational parameter of the self heating thermistor indicative of the presence of water to the condensate removal pump, wherein the combined sensor and suction tube assembly is sized to fit within a pipe having an inner diameter of no more than 20 mm.

The combined sensor and suction tube assembly of the present invention is advantageous as it can be easily fitted within a confined space.

In a preferred example, the combined sensor and suction tube assembly is sized to fit within a pipe having an inner diameter of no more than 17 mm. More preferably, the combined sensor and suction tube assembly is sized to fit within a pipe having an inner diameter of no more than 14 mm to allow it to fit within a current standard diameter air conditioning unit drainage pipe.

The self heating thermistor is preferably located proximate the distal end of the tube so that the pump will continue to operate until the water has reached the proximity of the distal end of the tube.

Preferably, the combined sensor and suction tube assembly further comprises a second self heating thermistor which is located between the self heating thermistor and the proximal end of the tube. This second self heating thermistor provides an emergency level sensor in the event of a system failure.

In one preferred example the combined sensor and suction tube assembly comprises a housing surrounding at least a portion of the tube and self heating thermistor to protect the self heating thermistor from being chilled by surrounding air.

The proximal end of tube is preferably arranged to be connected to the condensate removal pump by a hose. Preferably the distal end of the tube has a rim which is profiled in the axial direction of the tube such that only a portion of the rim lies in a plane which is located at the extreme distal end of the tube and which is perpendicular to the axis of the tube. This configuration helps to prevent gurgling by helping to prevent a mixture of water and air being drawn into the tube.

In another preferred example the combined sensor and suction tube assembly comprises a resilient membrane which extends across the interior of the tube, the membrane having at least one slit which is arranged to open to allow water to pass through the membrane when water is drawn through the tube by a condensate removal pump. This is advantageous as the membrane helps to prevent noise escaping from within the tube.

In a third aspect, the present invention provides a combination of a conduit according to the first aspect of the present invention and a combined sensor and suction tube assembly according to the second aspect of the present invention, wherein the conduit is arranged to be connected to the distal end of the combined sensor and suction tube assembly.

An example of the present invention will now be described with reference to the following drawings in which.

Figure 1:
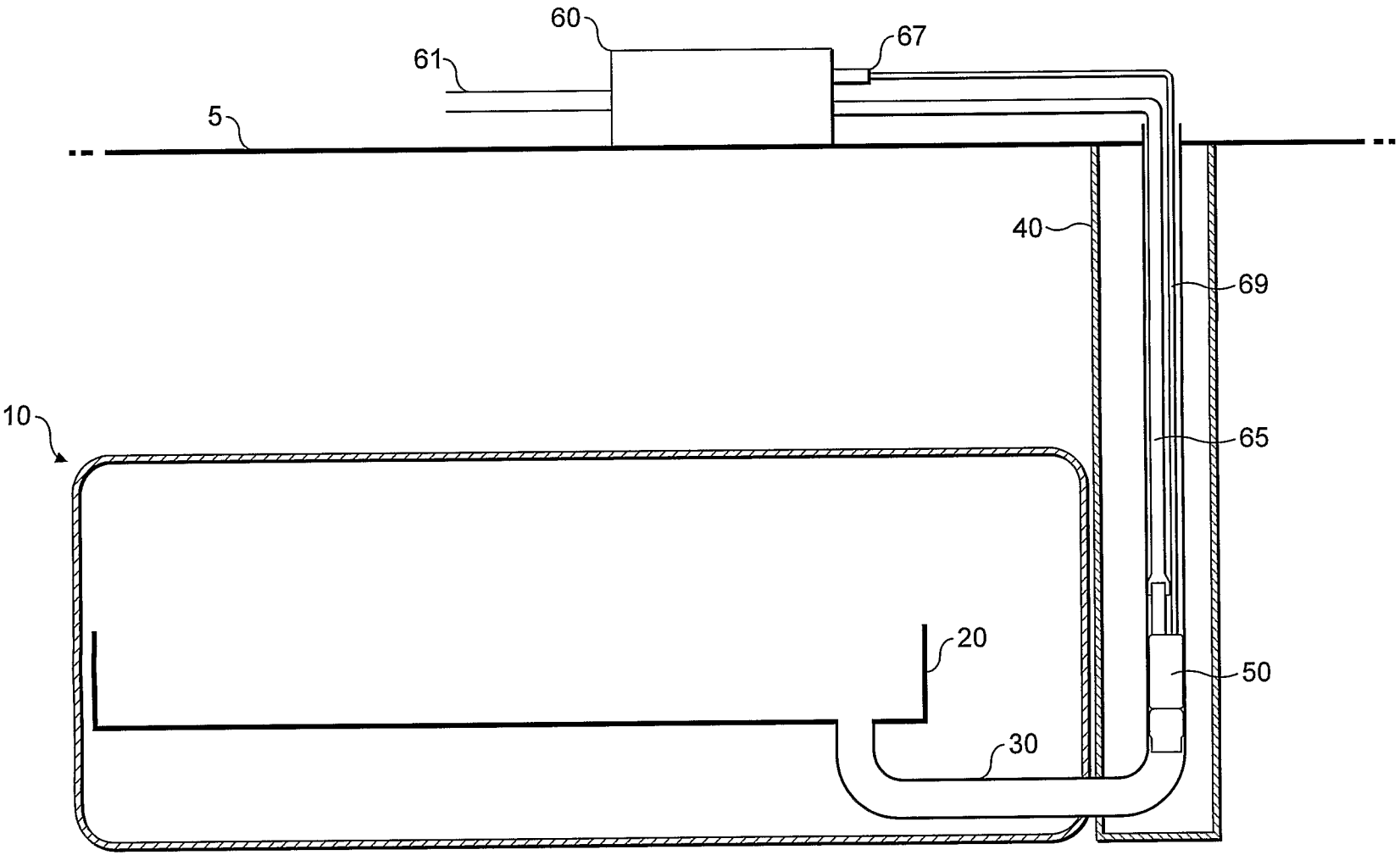
FIG. 1 shows a schematic view of a wall mounted air conditioning unit.

FIG. 1 shows a wall mounted air conditioning unit 10 which comprises a condensate tray 20 into which condensed water drips from the cooling fins (not shown). A 14 mm internal diameter drainage pipe 30 extends from the condensate tray 20, through plastic trunking 40 into a cavity above the ceiling 5. A self priming condensate removal pump 60 is located in the ceiling cavity for pumping the condensed water to an outside drain through discharge tube 61.

A combined sensor, suction tube and silencer assembly 50 is located within the drainage pipe 30. A hose 65 connects a proximal end 49 of the suction tube 55 (see FIG. 2) to the inlet of the pump 60 and a cable 69 connects self heating thermistors 56, 57 (see FIG. 2) to control circuitry of the pump 60 via connector 67.

Figure 2:
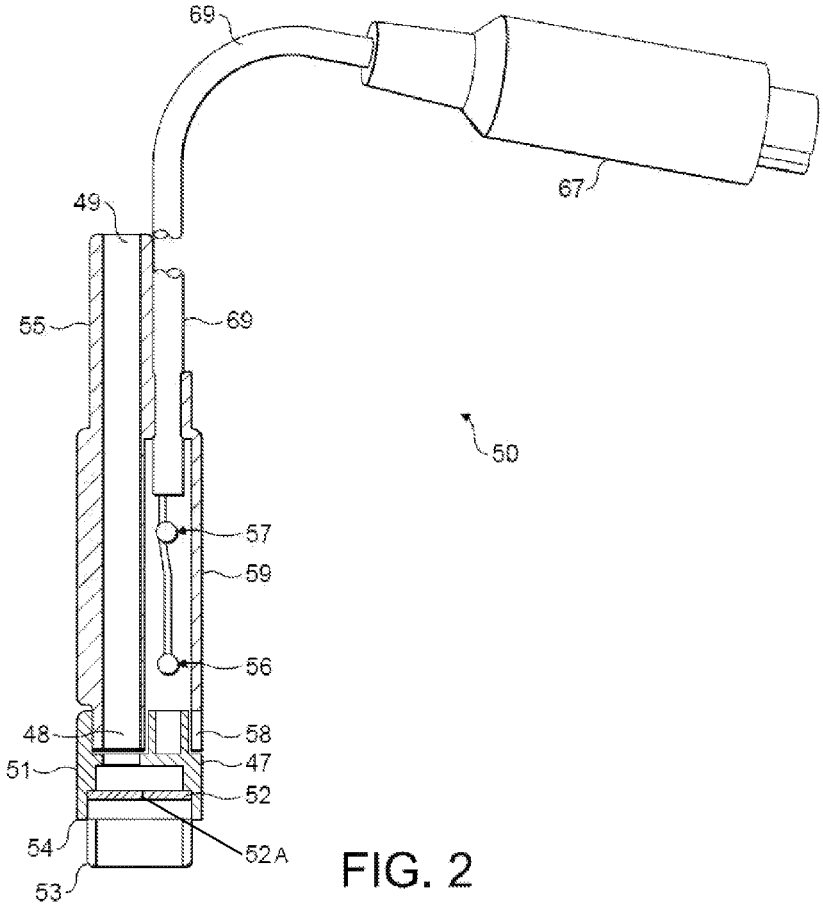
FIG. 2 shows a schematic cross-sectional view of a combined sensor, suction tube and silencer assembly according to the present invention.

Referring now to FIG. 2, the combined sensor, suction tube and silencer assembly 50 comprises a suction tube 55 located within a housing 59. First and second self heating thermistors 56, 57 are supported within the housing 59 by the cable 69 which is secured to the outer surface of the suction tube 55 by a clip (not shown). The first self heating thermistor 56 is located proximate the distal end 48 of the suction tube 55 and the second self heating thermistor is located approximately half way along the length of the suction tube 55.

Both self heating thermistors 56, 57 are provided with a small electrical current of approximately 20 mA each via cable 69. When there is no water present the self heating thermistors are hot and their electrical resistance is high. Conversely, when there is water present, the self heating thermistors are cooled by the water and their electrical resistance falls. The electrical resistance of the self heating thermistors is an operational parameter which may be relayed to the pump control circuitry via the cable 69 to indicate the presence or absence of water in the pipe 30.

The combined sensor, suction tube and silencer assembly 50 further comprises a silencer conduit 51 which comprises a tubular member 47 connected to the distal end 48 of the suction tube 55. A gap 58 is located between the housing 59 and the silencer conduit 51 to allow water to access the first and second self heating thermistors 56, 57.

Figure 3:
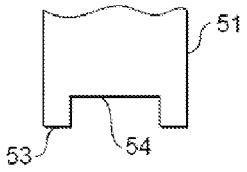
FIG. 3 shows a schematic view of the rim of the silencer of FIG. 2 turned through an angle of 90°.

The silencer conduit 51 has a profiled rim 53, 54 which has a castellated configuration such that lower portions of the rim 53 are located at the extreme distal end of the silencer conduit 51 in a plane which is perpendicular to the axis of the tubular member 47, and upper portions of the rim 54 are located in a plane perpendicular to the axis of the tubular member 47 but located further towards the proximal end of the suction tube 55. FIG. 3 shows an alternative view of the rim 53, 54 at 90° to the view shown in FIG. 2. A resilient membrane 52 extends across the interior of the tubular member 47 to help prevent noise from within the suction tube 55 and hose 65 escaping. The resilient membrane 52 has a slit 52A which is arranged to open to allow water to pass through the membrane when water is sucked through the suction tube 55 by the pump 60. When air is drawn through the suction tube 55 the slit 52A remains substantially closed thereby helping to prevent noise from within the suction tube 55 and hose 65 escaping.

In use the combined sensor, suction tube and silencer assembly 50 is suspended within the drainage pipe 30 of the air conditioning unit 10. Condensed water is collected by the condensate tray 20 and flows into the drainage pipe 30 where it encounters the lower end of the combined sensor, suction tube and silencer assembly 50. Initially the pump 60 does not operate so that the water level in the drainage pipe 30 continues to rise until it encounters the first self heating thermistor 56. At this point the electrical resistance of the self heating thermistor 56 falls and the pump is switched on.

If the first self heating thermistor 56 should fail, the second self heating thermistor 57 provides an emergency water level sensing facility as a fail safe.

When the pump 60 is operating the level of the water falls until it reaches the profiled rim 53, 54. The surface of the water forms a meniscus on the outer surface of the tubular member 47 due to surface tension. As the water level moves past the rim 53, 54 the meniscus clings onto the rim 53, until the water level has decreased to such an extent that the surface tension is no longer sufficient to maintain the meniscus in contact with the rim 53, 54. At this point the meniscus breaks suddenly.

While the meniscus remains intact, air is unable to pass into the tubular member 47. However, when the meniscus breaks, only air passes into the tubular member 47 through the gap created between the surface of the water and the rim 53, 54.

Figure 4:
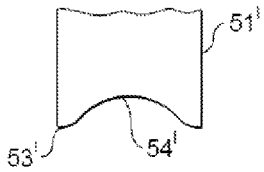
FIG. 4 shows a schematic view of an alternative rim configuration.

FIG. 4 shows an alternative configuration for the profiled rim of the silencer conduit 51. In this example the lower portion of the rim 54' has a curved shape.

Figure 5:
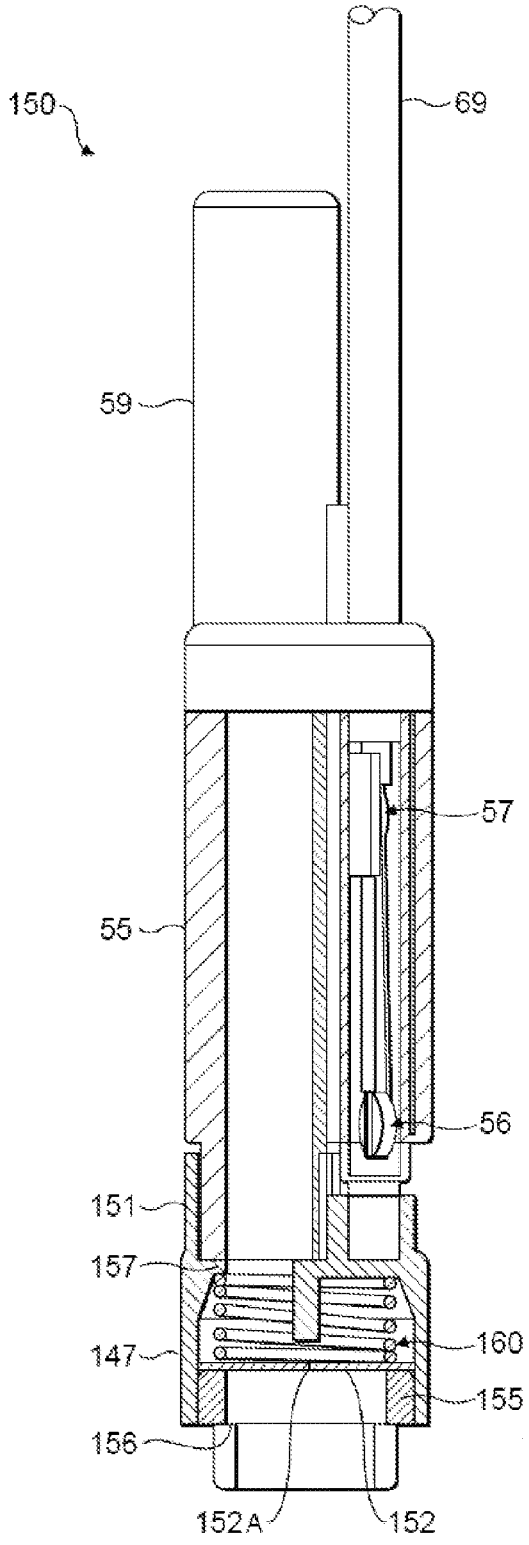
FIG. 5 shows a schematic cross-sectional view of a second embodiment of a combined sensor, suction tube and silencer assembly according to the present invention.

FIG. 5 shows a second embodiment of a combined sensor, suction tube and silencer assembly 150 according to the present invention. Where possible like reference numerals have been used to indicate like features.

The combined sensor, suction tube and silencer assembly 150 comprises a suction tube 55 located within a housing 59.

First and second self heating thermistors 56, 57 are supported within the housing 59 by a cable 69.

The combined sensor, suction tube and silencer assembly 150 further comprises a silencer conduit 151 which comprises a tubular member 147 connected to the suction tube 55. The rim of the silencer conduit 151 may be as described above with reference to any one of FIG. 2, 3 or 4.

A support ring 155 is fixed within the tubular member 147 and a resilient membrane 152 is supported on the support ring 155. The resilient membrane 152 extends across the interior of the tubular member 147 and has a slit 152A which is arranged to open to allow water to pass through the membrane when water is sucked through the suction tube 55. The support ring 155 bears against a shoulder 156 formed in the silencer conduit 151. A helical spring 160 is located within the tubular member 147. The helical spring bears against the upper surface of the resilient membrane 152 at its lowermost end and against a rim 157 formed in the silencer conduit 151 at its uppermost end.

The strength of the helical spring 160 is such that it holds the resilient membrane 152 in place against the support ring 155 during normal operation of the combined sensor, suction tube and silencer assembly 150. That is to say when there is no blockage of the slit 152A in the resilient membrane 152. However, should the slit 152A in the resilient membrane 152 become blocked, the helical spring 160 will compress to allow the resilient membrane 152 to move upwardly within the tubular member 147 to allow water to pass into the suction tube 55. This provides an additional safeguard in the event that the resilient membrane 152 becomes blocked by debris.

In an alternative embodiment (not shown) the resilient membrane 152 may be fixedly attached to the support ring 155 and the support ring 155 may be moveable with respect to the tubular member 147. In a further alternative example (not shown) the support ring 155 may be arranged to pivot within the tubular member 147 about a sprung hinge. In this embodiment the sprung hinge is arranged to hold the support ring in place during normal operation, and to allow the support ring to move, to allow water to flow into the suction tube 55, in the event that the slit in the resilient membrane becomes blocked.

It is not necessary for the combined sensor, suction tube and silencer assembly 50 to be located within the drainage pipe 30 of the air conditioning unit 10. If desired the combined sensor, suction tube and silencer assembly 50 could be suspended directly into the condensate tray 20 or other reservoir of liquid to be removed. The pump may be a gravity fed pump, appropriately positioned, rather than a self priming pump.

In an alternative example (not shown) the silencer conduit 51 could be an integral part of the suction tube 55. Alternatively the assembly 50 could be without a silencer conduit 51.

In yet another example, the silencer conduit 51 could be used in combination with a known sensor assembly such as a differential temperature sensor, float switch or conductivity probe.

The invention claimed is:

1. A conduit for a condensate removal pump comprising:

a tubular member having a rim at a distal end thereof, wherein the rim is profiled such that only a portion of the rim lies in a plane which is located at the extreme distal end of the tubular member and which is perpendicular to the axis of the tubular member, and a resilient membrane which extends across the interior of the tubular member, the membrane having at least one slit which is arranged to open to allow water to pass through the membrane when water is drawn through the conduit by a condensate removal pump, wherein the membrane is supported by a support member and wherein the membrane is moveable with respect to the tubular member, the conduit further comprising a resilient member for controlling movement of the membrane, and the tubular member further comprises a housing defining an open chamber within which a first and second thermistor are located.

2. A conduit as claimed in claim 1 wherein the rim has a castellated configuration.

3. A conduit as claimed in claim 1 wherein the membrane comprises a single slit.

4. A conduit as claimed in claim 1 wherein the membrane is located proximate the distal end of the tubular member.

5. A condensate removal system including a combined sensor and suction tube assembly, the combined sensor and suction tube assembly comprising:

a tube having a proximal end which is arranged to be connected to the inlet of a condensate removal pump and a distal end which is arranged so that water may be drawn through the tube, a first and second self heating thermistors coupled to the tube, a cylindrical housing within which the tube and the self heating thermistors are located, and a relay means which is arranged to relay an operational parameter of the self heating thermistors indicative of the presence of water to the condensate removal pump, wherein the tube and the self heating thermistors are connected to the cylindrical housing, the cylindrical housing surrounding said tube and defining an open chamber adjacent to said tube to hold said self heating thermistors, and wherein the combined sensor and suction tube assembly is sized to fit within a pipe having an inner diameter of no more than 20mm.

6. A combined sensor and suction tube assembly as claimed in claim 5 which is sized to fit within a pipe having an inner diameter of no more than 17mm.

7. A combined sensor and suction tube assembly as claimed in claim 5 which is sized to fit within a pipe having an inner diameter of no more than 14mm.

8. A combined sensor and suction tube assembly as claimed in claim 5 wherein the first self heating thermistor is located proximate the distal end of the tube.

9. A combined sensor and suction tube assembly as claimed in claim 8, wherein the second self heating thermistor is located between the first self heating thermistor and the proximal end of the tube.

10. A combined sensor and suction tube assembly as claimed in claim 5 wherein the proximal end of tube is arranged to be connected to the condensate removal pump by a hose.

11. A combined sensor and suction tube assembly as claimed in claim 5 wherein the distal end of the tube has a rim which is profiled in the axial direction of the tube such that only a portion of the rim lies in a plane which is perpendicular to the axis of the tube and which is located at the extreme distal end of the tube.

12. A combined sensor and suction tube assembly as claimed in claim 5 further comprising a resilient membrane which extends across the interior of the tube, the membrane having at least one slit which is arranged to open to allow water to pass through the membrane when water is drawn through the tube by a condensate removal pump.

13. The combined sensor and suction tube assembly as claimed in claim 12 wherein the at least one slit is closed when no water is drawn through the tube.

14. The combined sensor and suction tube assembly as claimed in claim 1, wherein the at least one slit is closed when no water is drawn through the conduit.

* * * * *